US009196181B2

(12) United States Patent
Hubner-Polli et al.

(10) Patent No.: US 9,196,181 B2
(45) Date of Patent: Nov. 24, 2015

(54) DRINKING GLASS MARKER APPARATUS

(75) Inventors: M Francesca Hubner-Polli, Franklin Lakes, NJ (US); Cynthia Phillips, Wuckoff, NJ (US)

(73) Assignee: M. Francesca Hubner-Polli, Franklin Lakes, NJ (US)

( * ) Notice: Subject to any disclaimer, the term of this patent is extended or adjusted under 35 U.S.C. 154(b) by 0 days.

(21) Appl. No.: 13/481,860

(22) Filed: May 27, 2012

(65) Prior Publication Data

US 2012/0234847 A1 Sep. 20, 2012

Related U.S. Application Data

(63) Continuation of application No. 12/228,004, filed on Aug. 8, 2008, now abandoned.

(51) Int. Cl.
*B65D 25/00* (2006.01)
*G09F 23/06* (2006.01)

(52) U.S. Cl.
CPC ..... *G09F 23/06* (2013.01)

(58) Field of Classification Search
CPC ..... G09F 3/16; G09F 3/06
USPC ..... 220/694, 752; 215/274, 275; 24/704.1, 24/704.2
See application file for complete search history.

(56) References Cited

U.S. PATENT DOCUMENTS

| | | | | | |
|---|---|---|---|---|---|
| 4,129,228 | A * | 12/1978 | Stoneback | ..... | 220/293 |
| 4,176,756 | A * | 12/1979 | Gellman | ..... | 215/274 |
| 4,377,245 | A * | 3/1983 | Patty | ..... | 220/822 |
| 5,655,805 | A * | 8/1997 | Shaddy | ..... | 294/31.2 |
| 6,098,256 | A * | 8/2000 | Poussard | ..... | 24/704.1 |
| 6,741,150 | B2 * | 5/2004 | Holmes et al. | ..... | 335/207 |
| 7,178,546 | B2 * | 2/2007 | Gremillion, III | ..... | 137/15.01 |
| 2001/0054817 | A1 * | 12/2001 | Kelley et al. | ..... | 283/70 |

* cited by examiner

*Primary Examiner* — Jeffrey Allen
(74) *Attorney, Agent, or Firm* — Len Taylor, Esq.

(57) ABSTRACT

The apparatus according to present invention comprises a combination of a drinking vessel and a geometrically shaped collar that is divided into at least two pieces such that the collar can encircle and snugly fit onto a stem or handle of a glass, cup or mug whereby when attached the collar is not movable relative to the stem or handle. When the at least two pieces of the collar are joined together to surround the stem of a glass, handle of a mug or the actual glass body itself, the geometrically shaped collar is restored to its original shape and form.

11 Claims, 4 Drawing Sheets

DRINKING GLASS MARKER APPARATUS

This application is a continuation of U.S. Non-Provisional application Ser. No. 12/228,004 filed Aug. 8, 2008 now abandoned hereby incorporated by reference and claims the benefit of U.S. Non-Provisional application Ser. No. 12/228,004 filed Aug. 8, 2008.

BACKGROUND OF THE INVENTION

1. Field of the Invention

The present invention relates to an apparatus that can be used to decorate a drinking glass such as a wineglass, to identify a drinking glass as being used by or belonging to a specific individual and if desired to be given away as a party favor or gift. In particular a decorative collar is fashioned as a piece of jewelry from a precious metal such as gold or platinum, a semi-precious metal such as silver or copper, or any combination of precious and semi-precious metals, however other materials such as plastics, rubbers, woods, industrial metals can be used. Precious gem stones, semi-precious gem stones, fixed charms, removable charms, or any combination of gem stones and charms can be further added to the decorative collar for additional ornamentation, however other ornamental accents such as glass accents, plastic accents, wood accents, and metal accents may be used. The decorative collar can affix snugly at any position on a stem of a glass such as a wineglass or to a handle of a drinking cup such as a mug. The apparatus comprises at least one geometrically shaped decorative collar comprising at least two pieces such that the at least one geometrically shaped decorative collar can encircle a stem or handle of a glass, cup or mug when the at least two pieces that form the decorative collar are separated then joined together to surround the stem or handle of a glass or mug whereby the at least one geometrically shaped decorative collar is restored to its original shape and form. An embodiment according to the present invention comprises a first piece of the at least two pieces being joined to a second piece of the at least two pieces with a movable mechanism such as a hinge for a first connection and a locking/unlocking mechanism such as a fastener opposed to the movable mechanism for a second connection. Another embodiment according to the present invention comprises the at least two pieces having at least two interconnecting fasteners comprising a first side and a second side whereby the first side of the fastener and the second side of the fastener of a first of the at least two pieces are positioned opposite to a first side and a second side of the fastener located on a second of the at least two pieces such that when pressed together the first side of the first of the at least two pieces engages the second side of the second of the at least pieces and the second side of the first of the at least two pieces engages the first side of the second of the at least two pieces such that the first and second of the at least two pieces are locked together forming a collar. Another embodiment according to the present invention further includes at least one gasket insert constructed from a pliable material such as silicon, whereby the at least one gasket insert can be embedded into an inner surface of at least one of the at least two pieces of the decorative collar such that when the decorative collar is affixed to a stem or a handle of a glass, cup, mug or goblet, the gasket insert protects the stem or handle from scratches, breakage and further allows a snug fit to the glass stem or mug handle such that the decorative collar will remain non-movably fixed at whatever location on the stem or mug handle that it is affixed to. The decorative collar can also be constructed large enough to encircle and affix to the entire body of a drinking glass. Another embodiment according to the present invention comprises a plurality of geometrical shapes that are designed to be stackable such that the aesthetic features of each of the plurality of geometrical shapes accent and enhance each other whereby the stack of geometric shapes form one unit of jewelry or can be used separately as individual units of jewelry. If desired each of the geometric shapes that form the stack can be interlocking with one another however the geometric shapes can also be freely separable.

2. Description of Related Art

Throughout each year various types of social events and gatherings occur. Weddings, award ceremonies, children's birthday parties, and holiday parties are just a few examples of such events.

Food and beverages are typically served at these events. The nature of the event and where the event is held generally dictates how and with what type of tableware the food and beverages are served on. Food and beverages can be served on tableware ranging from throw-away paper plates and cups to china plates and crystal glassware.

At formal events beverages tend to be served to guests in non-throw away containers, such as crystal wineglasses, goblets, champagne glasses etc. When a guest finishes their drink and would like a refill they sometimes forget where they have left their original drink glass so the guest merely orders a replacement drink served in a different glass. Not only can this result in a number of empty or partially filled glasses remaining throughout the formal event area making clean-up more burdensome, it becomes necessary for the host of the party to have an adequate supply of glasses to accommodate refills for all of the guests.

Another common problem when serving beverages in non-disposable containers is that guests sometimes pick up a glass believing it to be their own and end up drinking from a glass that was used by someone else. This can be embarrassing and certainly is not sanitary.

A solution to the above problem is that of labeling a glass with a person's name. Stick on labels as well as round paper rings having a person's name have been used but are generally not appropriately used at a formal affair. Additionally either the host or the guest themselves are required to write a name on the label which is time-consuming and tedious.

Other solutions used in the past have been attempts to make wine charms and stemware trinkets but those attempts have proven largely unsatisfactory because they generally do not last long, easily fall off a glass, break because of fatigue, or are not aesthetically appealing for formal functions.

Thus a need exists for an apparatus that can be used to identify a glass as belonging to a particular individual, that is more aesthetically appeasing and fashionable, that can be given away as a party favor or gift, that is more durable, and that snuggly fits on a stem of a glass, handle of a cup or on a glass itself.

SUMMARY OF THE INVENTION

An apparatus according to present invention comprises a geometrically shaped collar comprising at least two pieces such that the collar can encircle and snugly fit onto a stem or handle of a glass, cup or mug such that when attached the collar is not movable relative to the stem or handle. When the at least two pieces of the collar are separated then joined together to surround the stem of a glass, handle of a mug or the actual glass body itself, the geometrically shaped collar is restored to its original shape and form.

An aspect of the present invention further comprises constructing the geometrically shaped collar from at least one of precious metals or semi-precious metals such that the collar has all of the attributes of fine jewelry. However other materials can also be used in the construction such as plastics, wood, industrial metals, and glass.

Another aspect of the present invention further comprises at least one gasket constructed of pliable material, the at least one gasket is embedded and affixed to an inner surface of the geometrically shaped collar.

Another aspect of the present invention further comprises decorative charms that are affixed to the collar such that the charms can be removable, permanently fixed or a combination of both.

Another aspect of the present invention further comprises a movable mechanism such as a hinge that joins the at least two pieces of the collar at a first position on a first piece of the at least two pieces and at a second position adjacent to the first position on a second piece of the at least two pieces such that the at least two pieces of the collar can be movably opened and movably closed relative to the hinge, and a fastening mechanism having a first unit and a second unit whereby the first unit of the fastening mechanism is attached to a first piece of the at least two pieces of the collar directly opposed to the movable mechanism and the second unit of the fastening mechanism is attached to a second piece of the at least two pieces of the collar directly opposed to the movable mechanism such that the first unit and second unit of the fastening mechanism can engage and disengage each other.

Another aspect of the present invention comprises a first piece of the at least two pieces of the collar being coupled to a second piece of the at least two pieces of the collar with a movable mechanism such as a hinge for a first connection whereby the first piece and the second piece of the at least two pieces pivot about the hinge and a locking/unlocking mechanism such as a fastener opposed to the movable mechanism for a second connection.

Another aspect of the present invention comprises at least two pieces of a collar having at least two interconnecting fasteners comprised of a first side and a second side whereby the first side of the fastener and the second side of the fastener of a first of the at least two pieces of the collar are positioned opposite to a first side, and a second side of the fastener located on a second of the at least two pieces such that when the at least two pieces are pressed together to form the collar the first side of the first of the at least two pieces of the collar engages the second side of the second of the at least pieces and the second side of the first of the at least two pieces of the collar engages the first side of the second of the at least two pieces such that the first and second of the at least two pieces are locked together forming a collar.

Another aspect of the present invention comprises at least two geometrically shaped collars that are stackable upon each other and are each divided into at least two pieces such that each of the at least two geometrically shaped collars can encircle and snugly fit onto a stem or handle of a glass, cup or mug whereby when attached to the stem or handle, the at least two geometrically shaped collars are not movable relative to the stem or handle and when stacked upon each other form an aesthetically appealing drinking glass marker.

Another aspect of the present invention comprises at least two geometrically shaped collars that are stackable and interlock with one another. The at least two geometrically shaped collars are each divided into at least two pieces such that each of the at least two geometrically shaped collars can encircle and snugly fit onto a stem or handle of a glass, cup or mug when the at least two pieces of each of the at least two geometrically shaped collars are separated then joined together to surround the stem or handle of a drinking vessel, the at least two geometrically shaped collars are not movable relative to the stem or handle and when stacked upon each other form an aesthetically appealing drinking glass marker.

Another aspect of the present invention further-comprises attaching at least one of name plates, removable charms, permanent charms to the drinking glass marker apparatus.

The above and yet other aspects and advantages of the present invention will become apparent from the hereinafter set forth Brief Description of the Drawings and Detailed Description of the Invention.

BRIEF DESCRIPTION OF THE DRAWINGS

Apparatus that are particular embodiments of the invention will now be described, by way of example, with reference to the accompanying diagrammatic drawings.

DETAILED DESCRIPTION OF THE INVENTION

The apparatus according to present invention comprises a geometrically shaped collar that is divided into at least two pieces such that the collar can encircle and snugly fit onto a stem or handle of a glass, cup or mug when the at least two pieces of the collar are separated then joined together to surround the stem or handle whereby when the collar is attached the collar is not movable relative to the stem or handle. When the at least two pieces of the collar are separated then joined together to surround the stem of a glass, handle of a mug or the actual glass body itself, the geometrically shaped collar is restored to its original shape and form.

Figures 1A, 1B:
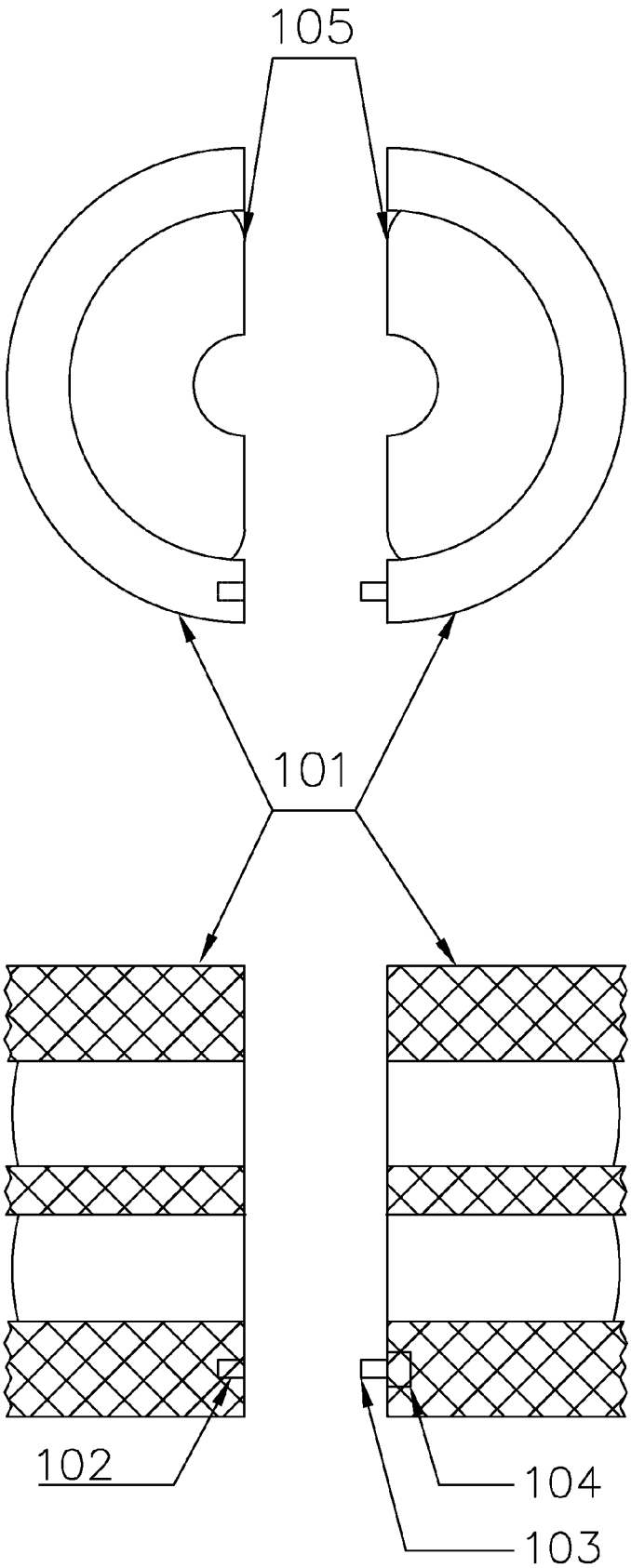
FIG. 1A illustrates top view of a drinking glass marker apparatus according to an embodiment of the present invention.
FIG. 1B illustrates an exterior side view of a drinking glass marker apparatus according to an embodiment of the present invention.

FIGS. 1A and 1B illustrate a drinking glass marker according to an embodiment of the present invention. FIG. 1A is a top view and FIG. 1B is an exterior side view. The drinking glass marker comprises at least two pieces 101 that can be symmetrical or asymmetrical. When connected the at least two pieces 101 of the drinking glass marker form a collar. The collar can be constructed into any geometrical shape such as a triangle, circle, heart, kidney, ellipse, u-shape, square, pentagon, hexagon or any other shape. Preferably the drinking glass marker further comprises at least one locking mechanism. Preferably the locking mechanism comprises a locking dock 102, a locking protrusion 103, and a locking release 104. The locking dock 102 is positioned on at least one of the at least two pieces 101 of the drinking glass marker. Directly opposed to the locking dock 102 is a locking protrusion 103 which is positioned opposite to the locking dock 102 on at least one of the at least two pieces of the drinking glass marker. To operate the locking mechanism the locking protrusion 103 which can be configured to have spring tension is inserted into its respective locking dock 102 and the at least two pieces of the drinking glass marker are squeezed together such that the locking protrusion 103 engages the locking dock 102. During usage each of the at least two pieces 101 of the drinking glass marker are positioned to surround a stem or handle of a glass in any position desired by the user. The locking mechanism is used to fasten the at least two pieces of the drinking glass marker together whereby a single unit is formed. The locking mechanism can be also be constructed using a hook and latch, magnetic clasps or any other device that would secure the at least two pieces of the collar together. Advantageously when the drinking glass marker is attached to the stem or handle of a glass, the drinking glass marker is stationary relative to the stem or handle of the glass, however the drinking glass marker can also be constructed to be movable relative to the stem or handle of the glass. To unlock the locking mechanism, the locking release 104 is depressed to release the spring tension of the locking protrusion 102 and the at least two pieces of the drinking glass marker will separate. Another embodiment according to the present invention further comprises at least one gasket insert 105 that is affixed to an inner surface of at least one of the at least two pieces of the drinking glass marker. The inner surface is the surface of the drinking glass marker that is in direct contact with a stem or handle of a glass. Preferably the at least one gasket 105 is constructed from pliable material such as neoprene, silicon, or rubber however other materials which are non-pliable can be used such as wood, plastics, or paper. An advantage of using a gasket insert is that the stem or handle of the glass will be protected from scratches or other damage. Another advantage of using a gasket insert is that when the drinking glass marker is attached to the stem or handle of a glass, the gasket insert ensures that the drinking glass marker will have a snug fit and not move from the position on the stem or handle of the glass that the drinking glass marker was placed on.

Figure 2:
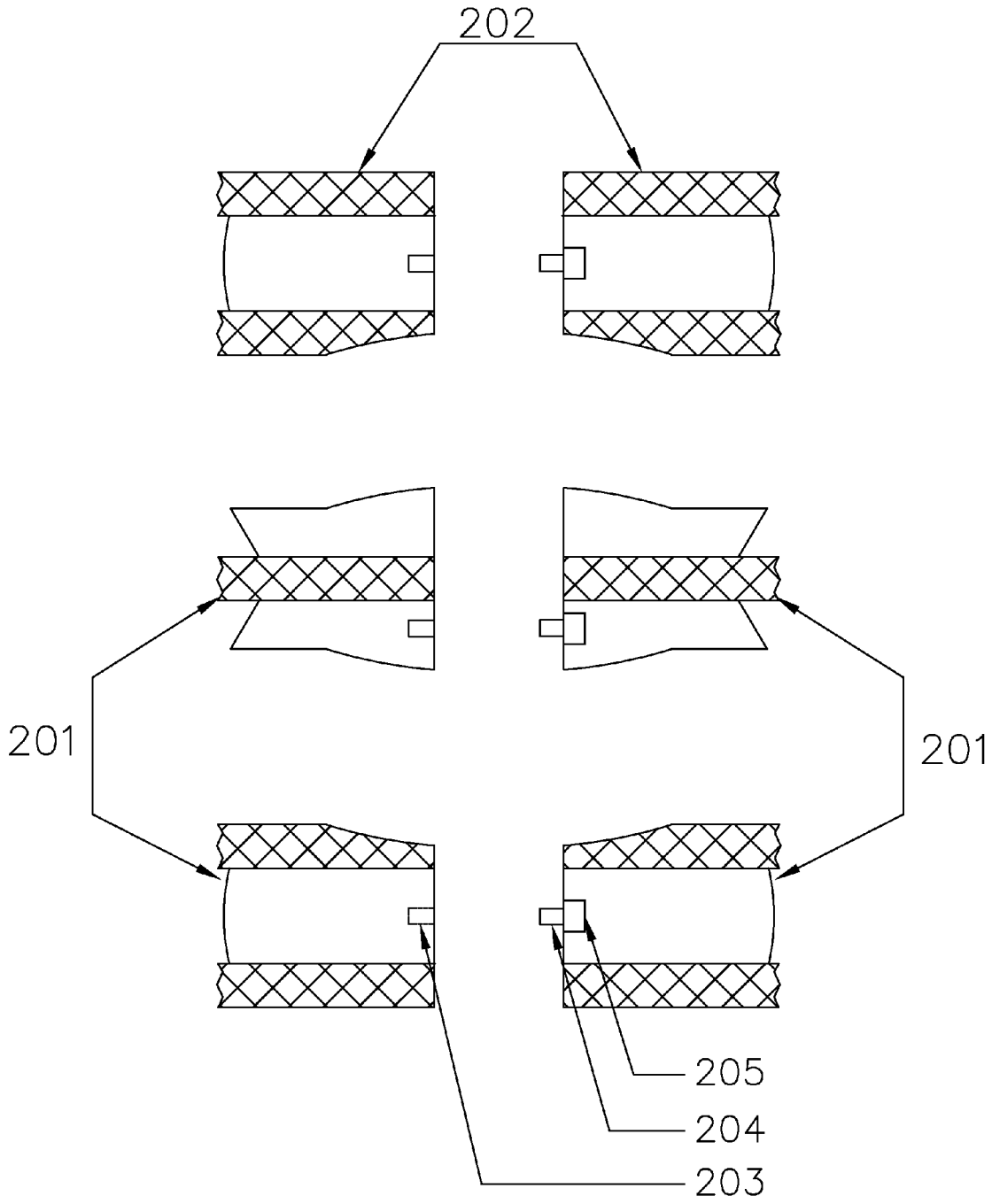
FIG. 2 illustrates a stackable drinking glass marker apparatus according to an embodiment of the present invention.

FIG. 2 illustrates a drinking glass marker according to an embodiment of the present invention. A drinking glass marker according to an embodiment of the present invention comprises a plurality of collars 201. The plurality of collars 201 are constructed to be a set such that when each collar of the plurality of collars 201 is stacked upon one another, the plurality of collars 201 gives the appearance of a single aesthetically appealing drinking glass marker. Preferably the shape of each of the plurality of collars 201 is a compliment to the shape of each of the plurality of collars 201 that it is adjacent to within the stack. Each of the plurality of collars 201 further comprises at least two pieces 202 that can be symmetrical or asymmetrical. When connected the at least two pieces 202 of each of the plurality of collars 201 form at least one of the plurality of collars 201 that make up the set. Each of the plurality of collars 201 that form the set will be attached to a stem or handle of a glass. The plurality of collars 201 that form the set can be constructed to interlock with one another, to be stackable with one another or both. Each of the plurality of collars 201 further comprises at least one locking mechanism. Preferably the at least one locking mechanism comprises a locking dock 203, a locking protrusion 204, and a locking release 205. The locking dock 203 is positioned on at least one of the at least two pieces 202 of each of the plurality of collars 201 that comprise the drinking glass marker. Directly opposed to the locking dock 203 is a locking protrusion 204 which is positioned on at least one of the at least two pieces 202 of each of the plurality of collars 201. To operate the locking mechanism the locking protrusion 204 which can be configured to have spring tension is inserted into its respective locking dock 203 and the at least two pieces 202 of each of the plurality of collars 201 are squeezed together such that the locking protrusion 204 connects with the locking dock 203. Another embodiment according to the present invention further comprises a gasket insert (described above with reference to FIG. 1) that is affixed to an inner surface of at least one of the at least two pieces of at least one of the plurality of collars. The gasket insert advantageously prevents a stem or handle of a glass from damage and additionally prevents the fully assembled drinking glass marker from movement relative to a stem or handle of a glass. Another embodiment according to the present invention comprises the plurality of collars to interlock with each adjacent collar. The interlocking of the plurality of collars can be accomplished by using a tongue and a groove mechanism (not shown) whereby the tongue of one of the plurality of collars is positioned adjacent to the groove of another of the plurality of collars such that the tongue of one collar engages the groove of its adjacent collar.

Figure 3A:
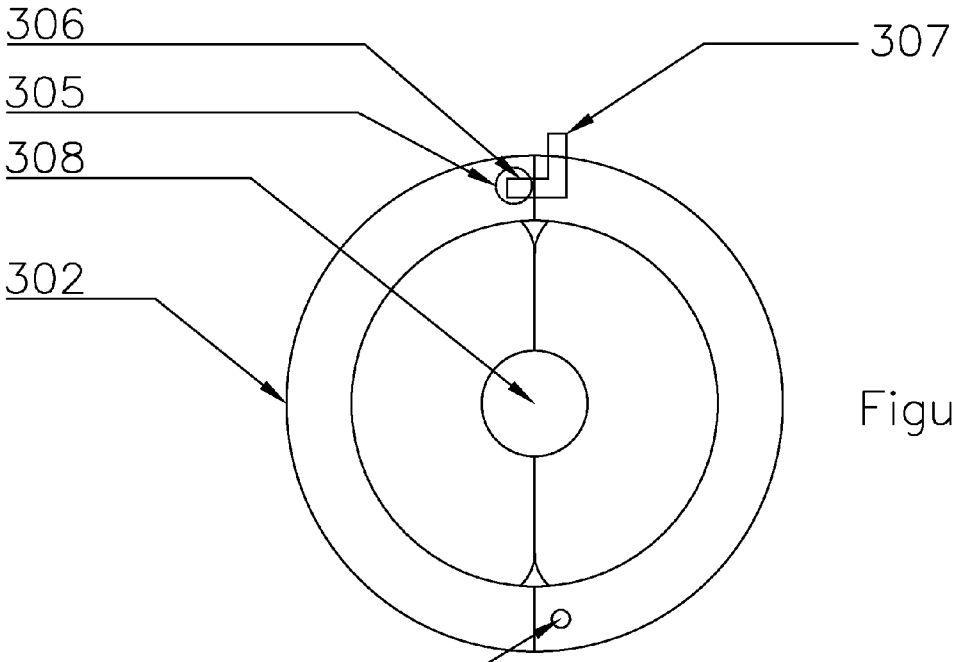
FIG. 3A illustrates a top view of a drinking glass marker apparatus having a hinge according to an embodiment of the present invention.
Figure 3B:
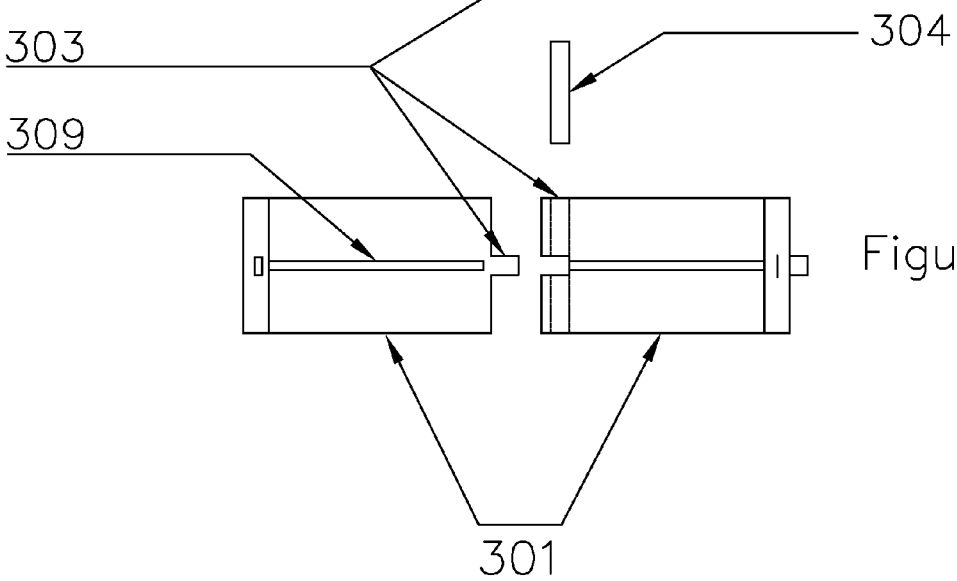
FIG. 3B illustrates an interior side view of a drinking glass marker apparatus having a hinge according to an embodiment of the present invention.

FIGS. 3A and 3B illustrate a drinking glass marker apparatus having a hinge according to an embodiment of the present invention. FIG. 3A is a top view and FIG. 3B is an interior side view. The drinking glass marker comprises at least two pieces 301 that can be symmetrical or asymmetrical. When connected the at least two pieces 301 of the drinking glass marker form a collar 302. The collar 302 can be constructed into any geometrical shape such as a triangle, circle, heart, kidney, ellipse, u-shape, square, pentagon, hexagon or any other shape. Each of the at least two pieces 301 of the collar is constructed with a hinge pin holder 303. A hinge pin 304 is placed into the hinge pin holder 303 such that the at least two pieces 301 are movably secured together. The drinking glass marker further comprises at least one locking mechanism. Preferably the at least one locking mechanism comprises a locking dock 305, a locking protrusion 306, and a locking release 307. The locking dock 305 is positioned on at least one of the at least two pieces 301 of the drinking glass marker. Directly opposed to the locking dock 305 is a locking protrusion 306 which is positioned on at least one of the at least two pieces of the drinking glass marker. To operate the locking mechanism the locking protrusion 306 which can be configured to have spring tension is inserted into its respective locking dock 305 and the at least two pieces of the drinking glass marker are squeezed together such that the locking protrusion 306 engages with the locking dock 305. During usage the at least two pieces 301 are opened by pivoting the at least two pieces 301 on the hinge pin 304 then positioning the interior sides at least two pieces 301 adjacent to a stem or handle of a glass at any position desired by the user such that the at least two pieces 301 surround or encircle the stem or handle of the glass. The at least two pieces 301 are then pivoted such that the at least two pieces 301 encircle the stem or handle of the glass and the locking mechanism is used to fasten the at least two pieces 301 of the drinking glass marker together to form a single closed unit. Advantageously when the drinking glass marker is attached to the stem or handle of a glass, the drinking glass marker is stationary relative to the stem or handle of the glass, however the drinking glass marker can also be constructed to be movable relative to the stem or handle of the glass. To unlock the locking mechanism, the locking release 307 is depressed to release the spring tension of the locking protrusion 306 and the at least two pieces of the drinking glass marker will separate. Another embodiment according to the present invention further comprises at least one gasket insert 308 that is affixed to at least one gasket holder 309 however the at least one gasket can be affixed directly onto an interior side of at least one of the at lest two pieces 301. Preferably the at least one gasket 308 is constructed from pliable material such as neoprene, silicon, or rubber however other materials which are non-pliable can be used such as wood; plastics, or paper. An advantage of using a gasket insert is that the stem or handle of the glass will be protected from scratches or other damage. Another advantage of using a gasket insert is that when the drinking glass marker is attached to the stem or handle of a glass, the gasket insert ensures that the drinking glass marker will have a snug fit and not move from the position on the stem or handle of the glass that the drinking glass marker was placed on. Another embodiment according to the present invention comprises a plurality of stackable hinged collars that compliment each other. The plurality of stackable hinged collars can be constructed to be stand alone collars or interlocking collars as described in reference to FIG. 2 above, however other interlocking mechanisms can be used such as an elongated hinge pin that can be inserted through two or more adjacently stacked collars.

Figure 4:
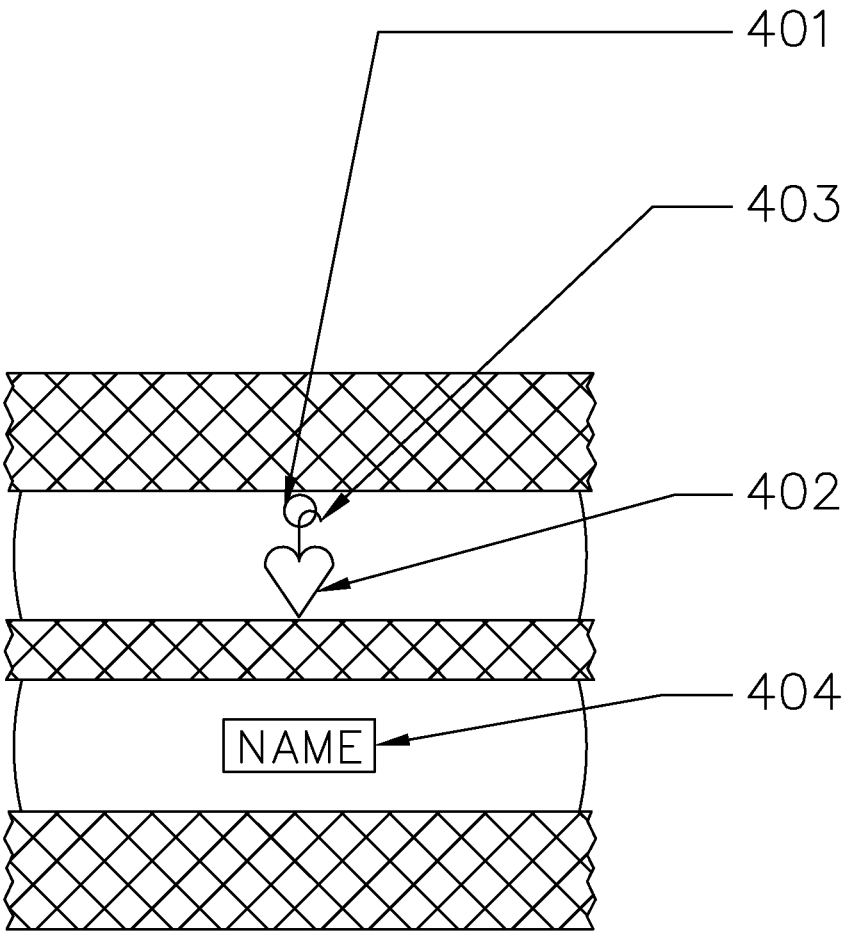
FIG. 4 illustrates a drinking glass marker according to an embodiment of the present invention.

FIG. 4 illustrates a drinking glass marker having a removable charm according to an embodiment of the present invention. A drinking glass marker according to an embodiment of the present invention comprises at least one charm link 401 whereby at least one decorative interchangeable charm 402 having a charm hook 403 that is compatible with the at least one charm link 401 can be connected to the at least one charm link 401 via the charm hook 403. The charm hook 403 can be constructed to have a safety latch such that the charm 402 will not disengage from the charm link 401 during usage. The use of at least one charm 402 advantageously allows users of the drinking glass marker to attach a unique charm 402 or multiple charms to the drinking glass marker to identify their own drinking glass. Additionally the drinking glass marker can be constructed to comprise at least one charm that is permanently affixed onto the drinking glass marker. Another embodiment according to the present invention comprises a name engraving plate 404 that is a permanent part of a surface of the drinking glass marker however the name engraving plate 404 can also be constructed to be a separate unit that can be removable or mounted permanently onto the drinking glass marker.

Having described embodiments for a drinking glass marker apparatus, it is noted that modifications and variations can be made by persons skilled in the art in light of the above teachings. It is therefore to be understood that changes may be made in the particular embodiments of the invention disclosed which are within the scope and spirit of the invention as defined by the appended claims.

What is claimed is:

1. A drinking glass marker apparatus comprising:

a combination of at least one of a wineglass, goblet, champagne glass; and a collar having at least two collar-pieces, wherein the at least two collar-pieces are constructed from at least one of gold, platinum, silver, precious gemstones, pearls, semi-precious gemstones;

at least one locking mechanism;

at least one hinge pin; and at least one hinge pin holder present on each of the at least two collar-pieces whereby when the at least one hinge pin is positioned into the at least one hinge pin holder, the at least two collar-pieces are attached to each other such that the at least two collar-pieces can pivot about the at least one hinge pin and be affixed onto at least one of a stem of a wineglass, a stem of a goblet and a stem of a champagne glass.

2. The drinking glass marker apparatus of claim 1, wherein the locking mechanism further comprises a locking protrusion affixed to one of the at least two collar-pieces and a locking dock for receiving the locking protrusion affixed directly opposite to the locking protrusion such that when the at least two collar-pieces are pressed together the locking protrusion of one of the at least two collar-pieces enters the locking docking of another of the at least two collar-pieces whereby the at least two collar-pieces are joined together to form the collar and a locking release that is affixed to the locking protrusion such that the locking protrusion will disengage from the locking dock when the locking release is depressed.

3. The drinking glass marker of claim 1, wherein the locking mechanism further includes at least one of a magnetic clasp, a hook and eye clasp, a hook and pin clasp, and screw clasp.

4. The drinking glass marker apparatus of claim 1, further comprising at least one gasket insert affixed to an inside surface of the at least two collar-pieces, the inside surface being the surface that is in contact with the at least one of a stem of a wineglass, a stem of a goblet and a stem of a champagne glass.

5. The drinking glass marker apparatus of claim 4, wherein the gasket insert comprises at least one of neoprene, rubber, silicon, plastic, paper, cork, a pliable material.

6. The drinking glass marker apparatus of claim 1, further comprising at least one of a charm and a name plate affixed to an outside surface of at least one of the at least two collar-pieces, the outside surface being the surface that is not in direct contact with the at least one of a stem of a wineglass, a stem of a goblet and a stem of a champagne glass.

7. The drinking glass marker apparatus of claim 1, further comprising at least one charm link for receiving at least one removable charm.

8. A drinking glass marker apparatus comprising:

a combination of at least one of a wineglass, goblet and champagne glass; and at least two collars each of the at least two collars having at least two collar-pieces, wherein the at least two collar-pieces are constructed from at least one of gold, platinum, silver, precious gemstones, pearls, semi-precious gemstones;

at least one locking mechanism comprising at least one of a magnetic clasp, a hook and eye clasp, a hook and pin clasp, screw clasp and a locking protrusion affixed to one of the at least two collar-pieces and a locking dock for receiving the locking protrusion affixed directly opposite to the locking protrusion such that when the at least two collar-pieces are pressed together the locking protrusion of one of the at least two collar-pieces enters the locking docking of another of the at least two collar-pieces whereby the at least two collar-pieces are joined together to form at least one of the at least two collars;

at least one hinge pin; and at least one hinge pin holder affixed to each of the at least two collar-pieces whereby when the at least one hinge pin is positioned into the at least one hinge pin holder, the at least two collar-pieces are attached to each other such that the at least two collar-pieces can pivot about the at least one hinge pin and be affixed onto a handle, stem, or neck of the at least one of a stem of a wineglass, a stem of a goblet and a stem of a champagne glass.

9. The drinking glass marker apparatus of claim 8, further comprising at least one gasket insert affixed to an inside surface of the at least two collar-pieces, the inside surface being the surface that is in contact with the at least one of a stem of a wineglass, a stem of a goblet and a stem of a champagne glass.

10. The drinking glass marker apparatus of claim 8, further comprising at least one of a charm and a name plate affixed to an outside surface of at least one of the at least two collar-pieces, the outside surface being the surface that is not in direct contact with the at least one of a stem of a wineglass, a stem of a goblet and a stem of a champagne glass.

11. The drinking glass marker apparatus of claim 8, further comprising at least one charm link for receiving at least one removable charm.

* * * * *